US006185852B1

(12) United States Patent
Whalen et al.

(10) Patent No.: US 6,185,852 B1
(45) Date of Patent: Feb. 13, 2001

(54) ELECTRONIC WEAPON SAFETY SYSTEM

(76) Inventors: Ronald F. Whalen, 3320 NW. 97th Way, Sunrise, FL (US) 33351; Michael M. Anthony, 6113 NW. 66th Way, Parkland, FL (US) 33067

( * ) Notice: Under 35 U.S.C. 154(b), the term of this patent shall be extended for 0 days.

(21) Appl. No.: 09/179,360

(22) Filed: Oct. 26, 1998

(51) Int. Cl.[7] ..... F41A 17/00
(52) U.S. Cl. ..... 42/70.11
(58) Field of Search ..... 42/70.11, 70.01, 42/70.02, 70.03, 70.04, 70.05–70.09

(56) References Cited

U.S. PATENT DOCUMENTS

| | | | | |
|---|---|---|---|---|
| 4,457,091 | * | 7/1984 | Wallerstein | 42/1 |
| 4,467,545 | | 8/1984 | Shaw, Jr. | 42/70.11 |
| 4,488,370 | * | 12/1984 | Lemelson | 42/70 |
| 4,739,569 | * | 4/1988 | Battle | 42/1.01 |
| 4,747,280 | * | 5/1988 | Shaw | 70/279 |
| 5,009,456 | * | 4/1991 | Eck | 292/173 |
| 5,062,232 | * | 11/1991 | Eppler | 42/70.11 |
| 5,219,386 | * | 6/1993 | Kletzmaier et al. | 70/277 |
| 5,416,472 | * | 5/1995 | Torii, Jr. | 340/825.32 |
| 5,459,957 | | 10/1995 | Winer | 42/70.11 |
| 5,502,915 | | 4/1996 | Mendelsohn et al. | 42/70.11 |
| 5,560,135 | | 10/1996 | Ciluffo | 42/70.07 |
| 5,570,528 | | 11/1996 | Teetzel | 42/70.11 |
| 5,603,179 | | 2/1997 | Adams | 42/70.08 |
| 5,616,817 | * | 4/1997 | Jones | 42/70.01 |
| 5,636,464 | | 6/1997 | Ciluffo | 42/70.11 |
| 5,675,925 | * | 10/1997 | Wurger | 42/70.11 |
| 5,704,151 | * | 1/1998 | West et al. | 42/70.06 |
| 5,704,153 | * | 1/1998 | Kaminski et al. | 42/70.11 |
| 5,953,844 | * | 9/1999 | Harling et al. | 42/70.06 |

* cited by examiner

*Primary Examiner*—Charles T. Jordan
*Assistant Examiner*—Denise J. Buckley
(74) *Attorney, Agent, or Firm*—Oltman, Flynn & Kubler

(57) ABSTRACT

A gun safety system for use with a gun having a barrel, a handle and a safety latch structured for movement from a first disabled position wherein the firing mechanism is inoperable to a second enabled position wherein the firing mechanism operable, comprising a substantially flat main housing attached to the gun handle over the safety latch and having voice and finger print sensing and verification circuitry and means for blocking access to the gun safety latch. The voice and finger print sensing and verification circuitry includes a sensing integrated circuit, having a finger print image surface matrix and a microphone sound sensor, and an authentication integrated circuit electrically interconnected to the sensing integrated circuit, structured to compare the gun user's voice pattern and finger print image to those stored in memory. The means for blocking the safety latch includes a bimetallic strip centrally disposed within a cavity, a capacitor electrically interconnected to a battery, the authentication integrated circuit and the strip, and a substantially flat blocking disk. The blocking disk is sized and shaped to cover access ports in the main housing so that in the absence of user authentication the safety latch is inaccessible. Upon user authentication, the blocking disk moves away from the access ports rendering the safety latch accessible.

17 Claims, 19 Drawing Sheets

ELECTRONIC WEAPON SAFETY SYSTEM

BACKGROUND OF THE INVENTION

1. Field of the Invention

The present invention relates to weapon safety devices, and more particularly, to a gun safety device which utilizes fingerprint and voice recognition to selectively enable operation and wireless means to disable operation and which is capable of maintaining usage history of the weapon.

2. Description of the Related Art

Over the past several years, the number of children killed by handguns has increased greatly. CNN and the National Center for Health Statistics reported that 5,285 children were killed by guns in 1995 (approximately 14 per day). A Department of Justice study revealed that approximately 13% of students say they know someone who brings guns to schools, while a separate study has revealed that nearly one million U.S. students brought guns to school during a recent academic year.

Often times, the children get the gun in their own homes. It is not uncommon for adults to keep loaded guns in their homes for security purposes. Frequently, such guns fall into the hands of their children or their children's friends, often times resulting in serious injury or death.

Although most guns include a safety latch to prevent accidental firing, they are designed to be easily unlatched so that the gun can be quickly enabled and fired. Thus, the safety latch, by itself, is not an effective deterrent to children.

Moreover, the safety latch, by itself, does not prevent unauthorized usage against the gun owner by an intruder who gains access to the gun. The intruder can merely slide the latch to the unlocked position and use the gun against its owner.

Several devices have been developed to address the need for a more effective safety device for weapons. For instance, U.S. Pat. Nos. 4,467,545, 5,502,915 and 5,603,179 disclose gun safety devices using finger or hand print identification to identify authorized users and enable operation. Similarly, U.S. Pat. Nos. 5,570,528 and 5,459,957 disclose gun safety devices using voice recognition circuitry to identify authorized users and enable operation.

Although useful for their intended purposes, these prior art devices have not proven to be entirely satisfactory. Specifically, these devices all utilize a solenoid, magnet or other electromechanical element coupled to the firing hammer or trigger to enable or disable firing of the gun. Thus, to utilize these prior art devices with existing guns, the guns must be disassembled to install the necessary hardware. Such disassembly, installation of the appropriate hardware and reassembly of the gun may be difficult to accomplish for many people, resulting in the safety device not being utilized.

Furthermore, these prior art devices are specifically designed so that upon fingerprint or voice authorization, the locking mechanism automatically unlocks allowing the gun to be immediately fired. Such an automatic firing ready feature may not always be desirable. For instance, if the device improperly disabled the safety mechanism, either because of a malfunction in the circuitry or because it incorrectly recognized a finger, hand or voice print, the gun will be fully enabled and ready to fire by merely pulling the trigger. Thus, it may be desirable to require further action, i.e., manual sliding of the safety latch, after authorization, before the gun may be fired.

Additionally, the prior art devices utilize only finger/hand print identification means or voice recognition means.

However, there may be instances when both finger/hand print identification and voice recognition are desired before the device is enabled.

Also, these prior art devices do not include means for a third party, such as a law enforcement officer, to disable the gun in the event it is being used against such officer or another person.

Accordingly, there is still a need in the art for a gun safety device capable of using both finger/hand print identification and voice recognition means to identify authorized users and enable firing, which may be used with existing guns without disassembling the gun and which does not automatically allow the gun to be fired after authorization by merely pulling the trigger. Any such device should include means for remotely disabling the gun in the event it is being used against a law enforcement officer or another person. The present invention is particularly suited to overcome those problems which remain in the art in a manner not previously known.

SUMMARY OF THE INVENTION

The present invention is directed towards a new and improved gun safety system for use with a gun having a barrel, a handle and a safety latch structured for movement from a first disabled position wherein the firing mechanism is inoperable to a second enabled position wherein the firing mechanism is operable, comprising a substantially flat main housing attached to the gun handle over the safety latch and having voice and finger print sensing and verification circuitry and means for blocking access to the gun safety latch. The voice and finger print sensing and verification circuitry is mounted within an internal chamber formed between the base and the cover and includes a sensing integrated circuit, having a finger print image surface matrix and a microphone sound sensor, and an authentication integrated circuit electrically interconnected to the sensing integrated circuit, structured to compare the gun user's voice pattern and finger print image to those stored in memory. The means for blocking the safety latch includes a bimetallic strip centrally disposed within a cavity, a capacitor electrically interconnected to a battery, the authentication integrated circuit and the strip, and a substantially flat blocking disk. The strip may either be disposed within the cavity vertically with the blocking disk attached to the top end or horizontally with the blocking disk seated above the strip. The blocking disk is sized and shaped to cover aligned access ports in the base and cover, in the absence of user authentication, thereby rendering the safety latch inaccessible. Upon user authentication, the capacitor releases its stored energy to the strip causing the two dissimilar metals comprising the strip to expand at different rates and the strip to bend away from its normal horizontal or vertical orientation, thereby enabling the blocking disk to move away from the access ports rendering the safety latch accessible. The authorized user may then slide or depress the safety latch allowing the gun to be fired by depressing the trigger. The firing pin may also be locked by means of a motor driven pin (FIG. 16) activated by an authorized person by fingerprint or voice print authorization.

It is an object of the present invention to provide a new and improved gun safety device which has all the advantages of the prior art devices and none of the disadvantages.

It is another object of the present invention to provide a gun safety device capable of using both finger print identification and voice recognition means to identify authorized users.

It is also an object of the present invention to provide such an apparatus which may be used with existing guns without disassembling the gun, as well as newly manufactured guns.

It is yet another object of the present invention to provide such an apparatus which does not automatically allow the gun to be fired after authorization by merely pulling the trigger.

It is yet a further object of the present invention to provide such an apparatus which includes means for remotely disabling the gun.

These and other objects and advantages of the present invention will become more readily apparent in the description which follows.

BRIEF DESCRIPTION OF THE DRAWINGS

For a fuller understanding of the nature of the present invention, reference should be made to the following detailed description, taken in connection with the accompanying drawings in which.

Like reference numerals refer to like parts throughout the several views of the drawings.

DETAILED DESCRIPTION OF THE PREFERRED EMBODIMENT

Figure 1:
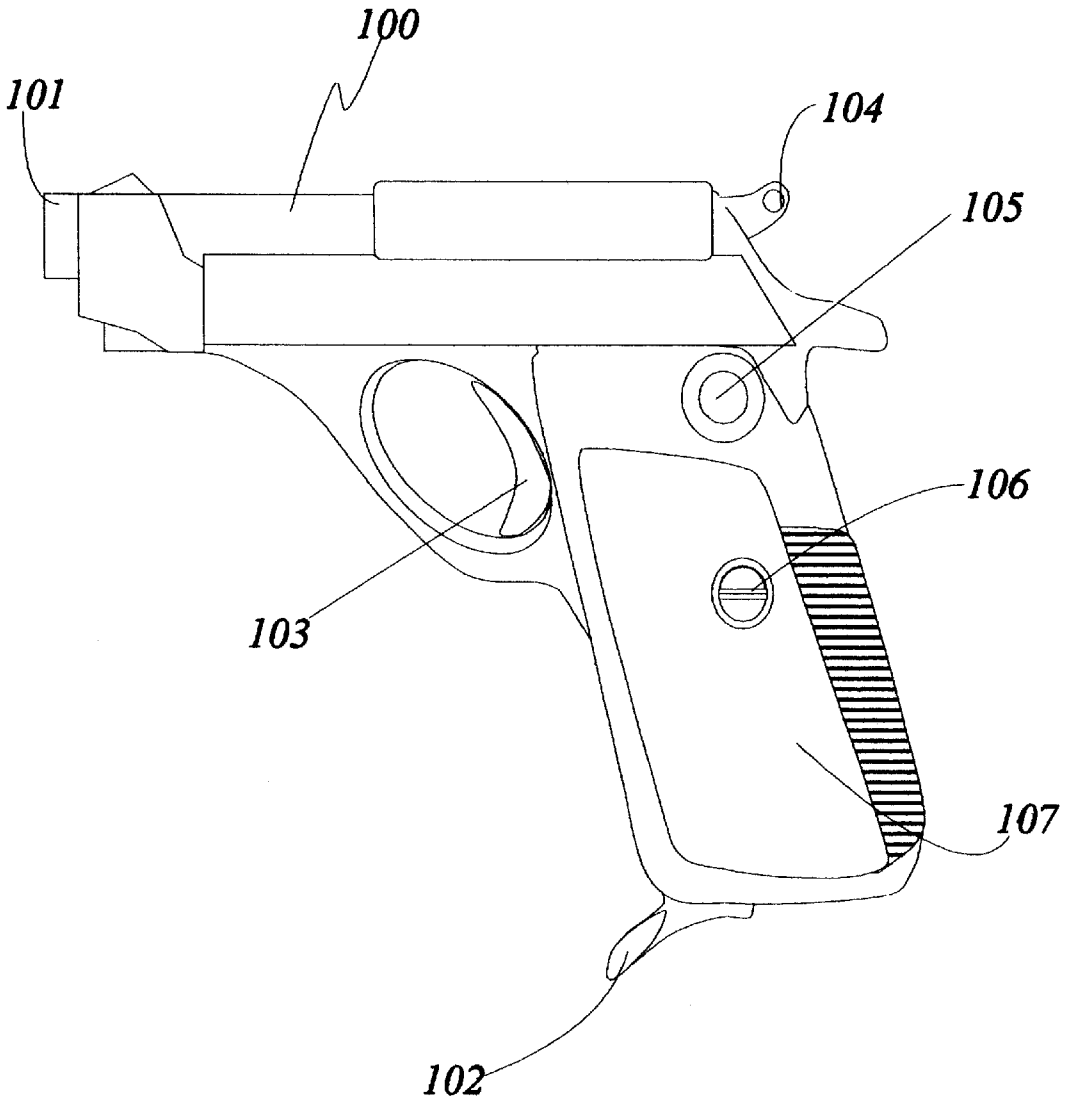
FIG. 1 is a side view of a gun showing a push button safety latch.
Figure 2:
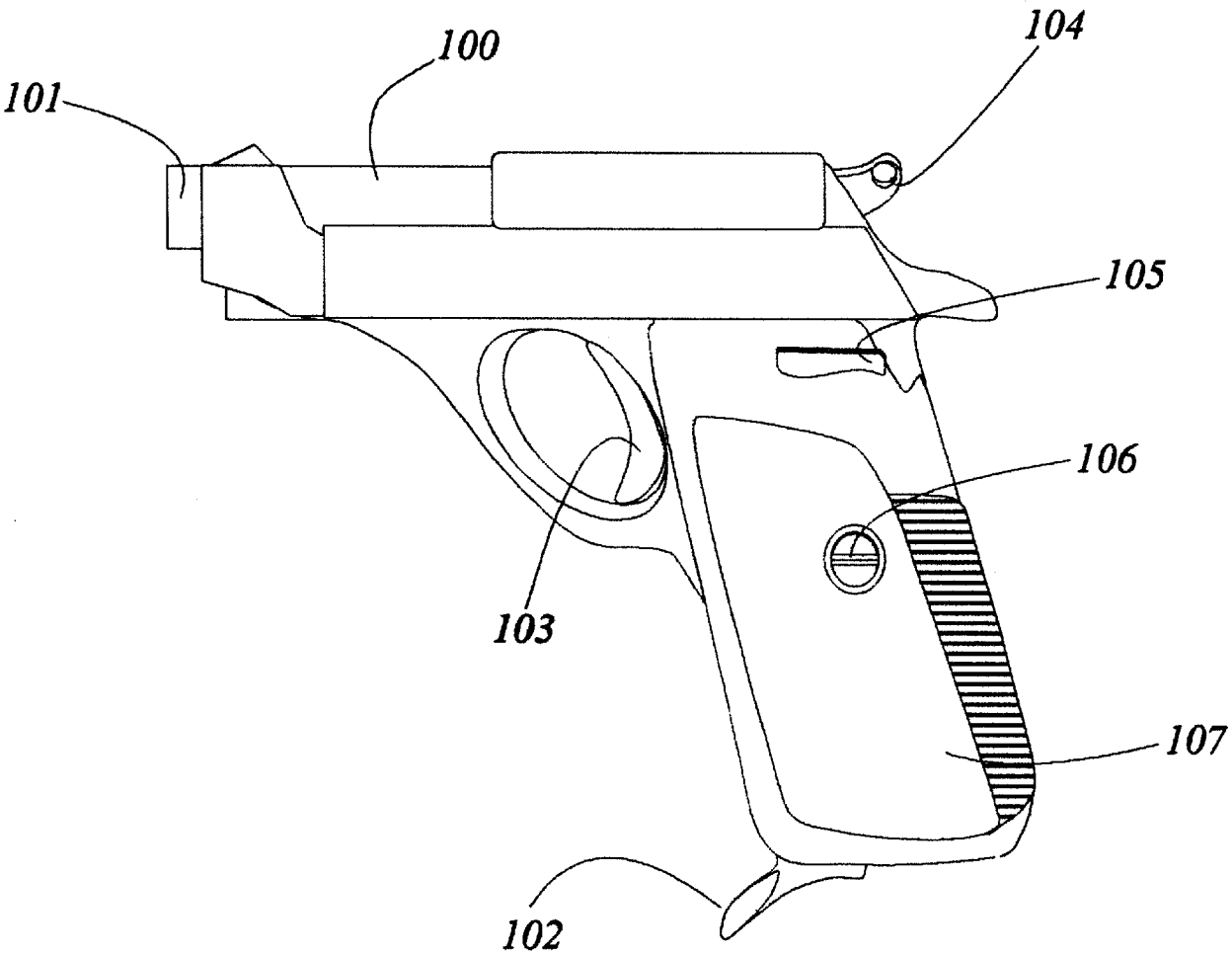
FIG. 2 is a side view of a gun showing a swinging safety latch.
Figure 3:
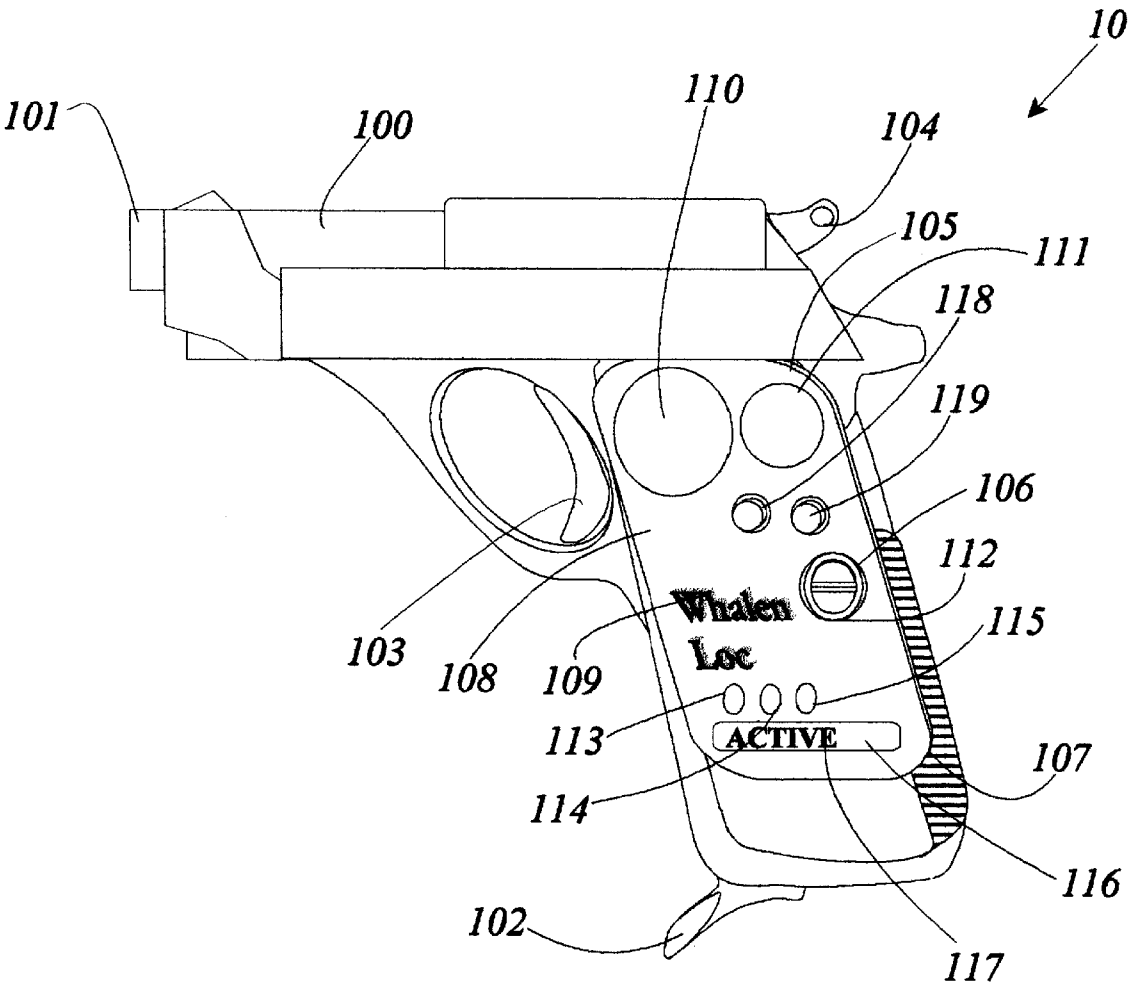
FIG. 3 is a side view of a gun with the safety system of the present invention mounted on the gun handle and the safety latch accessible through the access ports.
Figure 4:
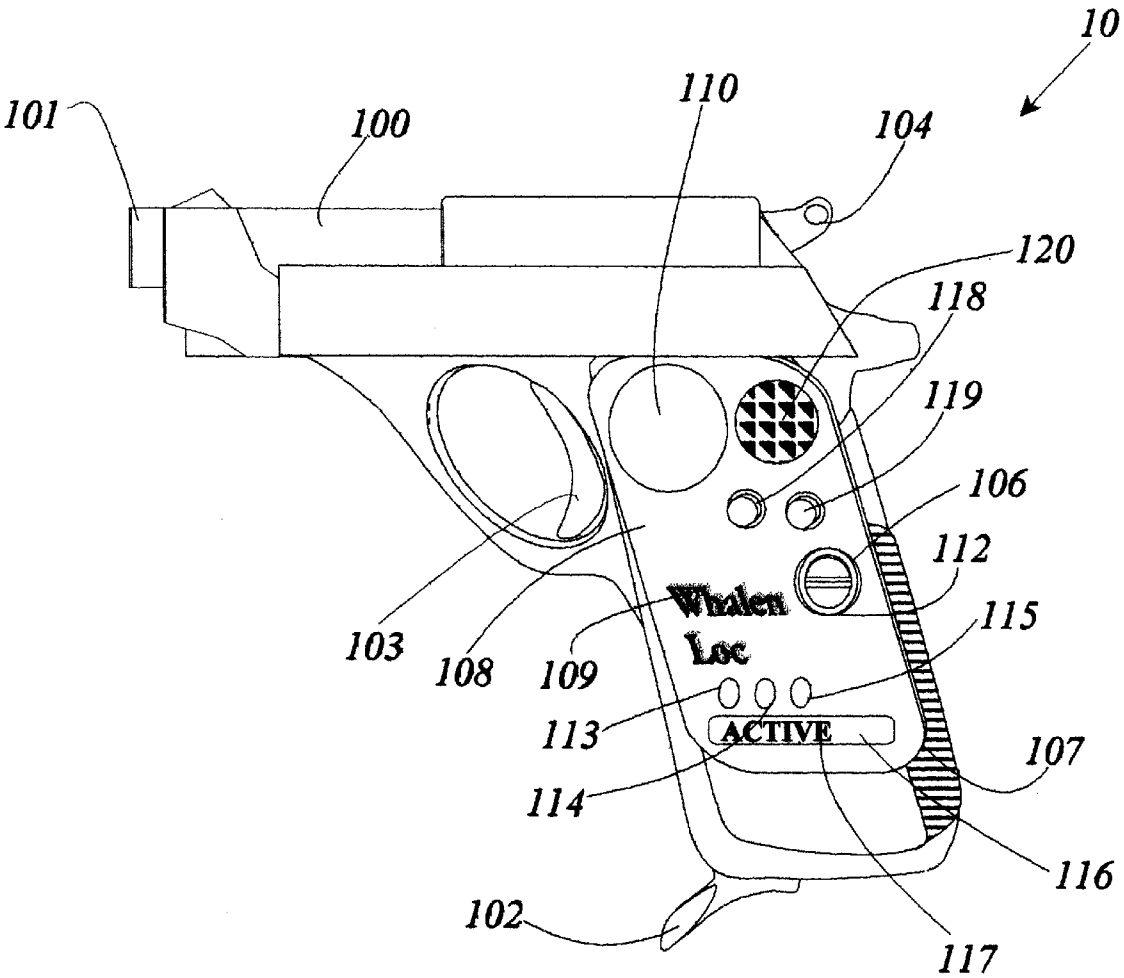
FIG. 4 is a side view of a gun with the safety system of the present invention mounted on the gun handle and the blocking disk covering the safety latch.

Before explaining the disclosed embodiment of the present invention in detail, it is to be understood that the invention is not limited in its application to the details of the particular arrangement shown since the invention is capable of other embodiments. Also, the terminology used herein is for the purpose of description and not of limitation.

As shown in FIGS. 1–19, the present invention is directed towards a new and improved gun safety system 10 comprising a gun 100 and a main housing 20 having voice and finger print sensing and verification circuitry 126 and means for blocking access to the gun 100 safety latch 105. The gun 100 may be of any type having a barrel 101, a trigger 103, a hammer 104, a handle 107 and a safety latch 105 structured for movement from a first disabled position wherein the firing mechanism is inoperable to a second enabled position wherein the firing mechanism is operable.

Figure 18:
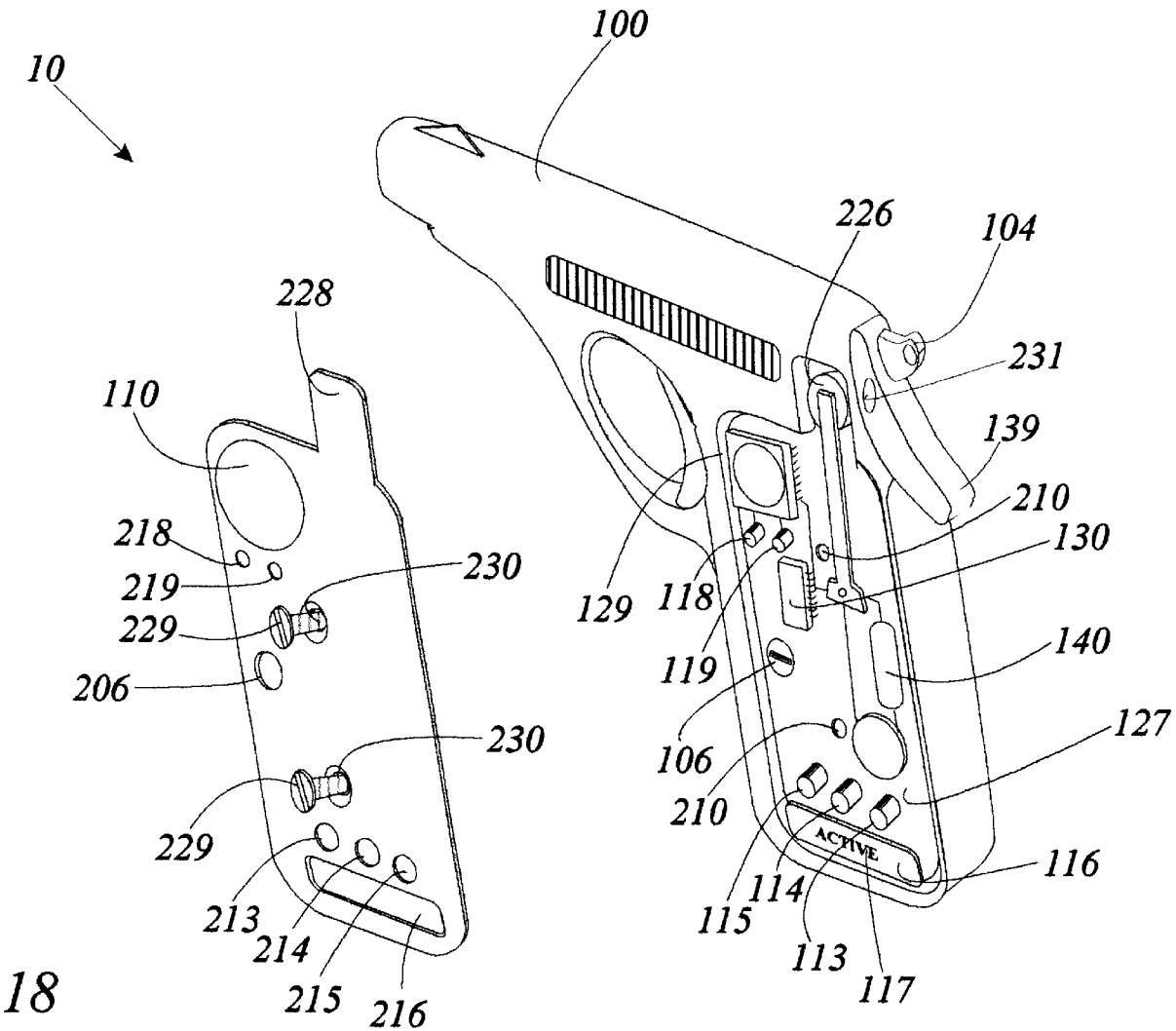
FIG. 18 is a perspective view of the present invention showing the safety system, with the cover removed, integrally installed within the gun handle and the safety pin removed from the hammer.
Figure 19:
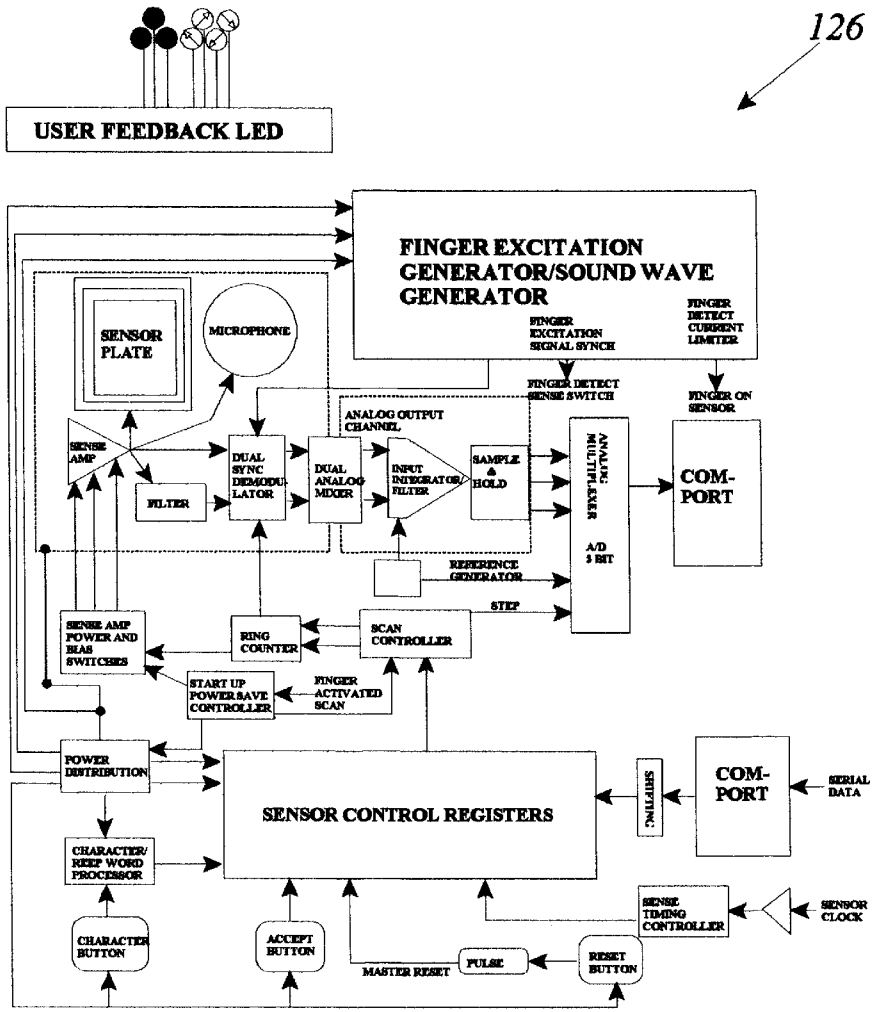
FIG. 19 is a block diagram of the voice and finger print sensing and verification circuitry.

The main housing 20 includes a base 121, structured for attachment to the handle 107 of the gun 100 over the safety latch 105, and a cover 34, structured for mating engagement with the base 121. The base 121 and cover 108 are structured to form an internal chamber 128 therebetween. The main housing 20 is substantially flat and sized and shaped to conform to the size and shape of the handle 107 of the gun 100 so that a user may grip the handle 107 and attached main housing 20 in the same manner that the user would grip the handle 107 without the main housing 20. In the preferred embodiment, the overall thickness of the main housing 20 is no more than_of an inch. The main housing 20 is preferably constructed of polypropylene or plastic, but may, alternatively, be constructed of any other suitable material. The base 121 may be attached to the handle 107 of guns 20 with glue or any other suitable adhesive material. This is most suitable when used with existing guns. Alternatively, as shown in FIGS. 18 and 19, the main housing 20 may be included as an integral part of the handle 107 of the gun 100. Such embodiment is most suitable for newly manufactured guns 20 and is discussed further below.

The voice and finger print sensing and verification circuitry 126 is mounted within the internal chamber 128 between the base 121 and the cover 108 and includes a sensing circuit 129 and an authentication circuit 130. Referring now to FIG. 20, the sensing circuit 129 includes a finger print image surface matrix and a microphone sound sensor. Such sensing circuits 129 are well known in the art. A typical sensing integrated circuit 129 is commercially available from Harris Semiconductor Corporation of Melbourne, Fla. The authentication circuit 130 is electrically interconnected to the sensing circuit 129 and is structured to compare the sample voice pattern and finger print image to those stored in memory. Such authentication circuits 130 are also well known in the art. Although both voice and finger print recognition circuitry is included in the preferred embodiment, it must be appreciated that alternative embodiments of the gun safety system 10 of the present invention may utilize either voice or finger print recognition circuitry without the other.

The voice and finger print sensing and verification circuitry 126 further includes data entry buttons 113, 114, 115, a liquid crystal display 116, a battery 127, a green LED indicator 118, and a red LED indicator 119. Data entry buttons 113, 114, 115 are provided to enter and store the voice and finger print images of the authorized users. Upon depressing button 113, alphanumeric characters stored in memory are displayed one by one in the display 116. The user can select and store in memory the first character of his or her name by depressing the second button 114. Additional characters of the user's name may then be entered in a similar manner. After all of the characters in the user's name have been entered, a user security code, provided to the owner of the system 10 upon its purchase and permanently stored within the system 10 memory, is entered in the same manner as the user's name. After the security code is entered, the user may then enter voice and finger print samples by depressing button 115, which activates the data entry mode of sensing integrated circuit 129. If an incorrect security code is entered, red LED 119 will illuminate indicating that the data has not been accepted. If the correct security code is entered, green LED 118 will illuminate, indicating that the data entry process is complete and accepted. The data entry process can be tested by placing the appropriate finger over the sensing integrated circuit 129 and/or repeating the word or code that was stored in memory to see whether or not the blocking means moves rendering the safety latch 105 accessible.

Cover 108 includes a protective membrane structured and disposed to cover sensing integrated circuit 129, a safety latch access port 111 disposed over a similar access port 211 in base 121 and safety latch 105 and holes 213, 214, 215, 216, 218, 219 structured and disposed to allow data entry buttons 113, 114, 115, display 116 and green and red LEDS 118, 119 to be accessible therethrough. Access ports 106, 206 may also be provided, as necessary, to provide access to a magazine release button 108. Latching lips 122, 123 along the upper and lower edges of the cover 108 are structured to mate with lips 222, 223 on the base 121 to secure the cover 108 to the base 121.

In a first preferred embodiment, the means for blocking the safety latch 105 includes a cavity 124 in the base 121 in the area over access port 211, a generally horizontally disposed strip 139 centrally disposed within the cavity 124, a capacitor 140 electrically interconnected to the battery 127, the authentication circuit 130 and the strip 139 and a substantially flat blocking disk 120 seated above the strip 139. The blocking disk 120 is sized and shaped to slide within the cavity 124 and, in the absence of user authentication, to cover access ports 111, 211, thereby rendering the safety latch 105 inaccessible. The strip 139 is constructed of two dissimilar metals, such as copper 125 and silver 225, attached together by electrostatic welds or any other suitable attachment means. Such dissimilar metals have different heat generating and expansion properties. Upon user authentication, the authentication circuit 130 generates a signal causing capacitor 140 to release its stored energy to strip 139. As current passes through the strip 139, the silver portion 225 expands faster and longer than the copper portion 125 causing the strip 139 to bend away from its normal horizontal orientation and blocking disk 120 to drop beneath strip 139 and away from access ports 111, 211, thereby rendering the safety latch 105 accessible. The authorized user may then slide or depress the safety latch allowing the gun 100 to be fired by depressing the trigger 103.

Figure 5:
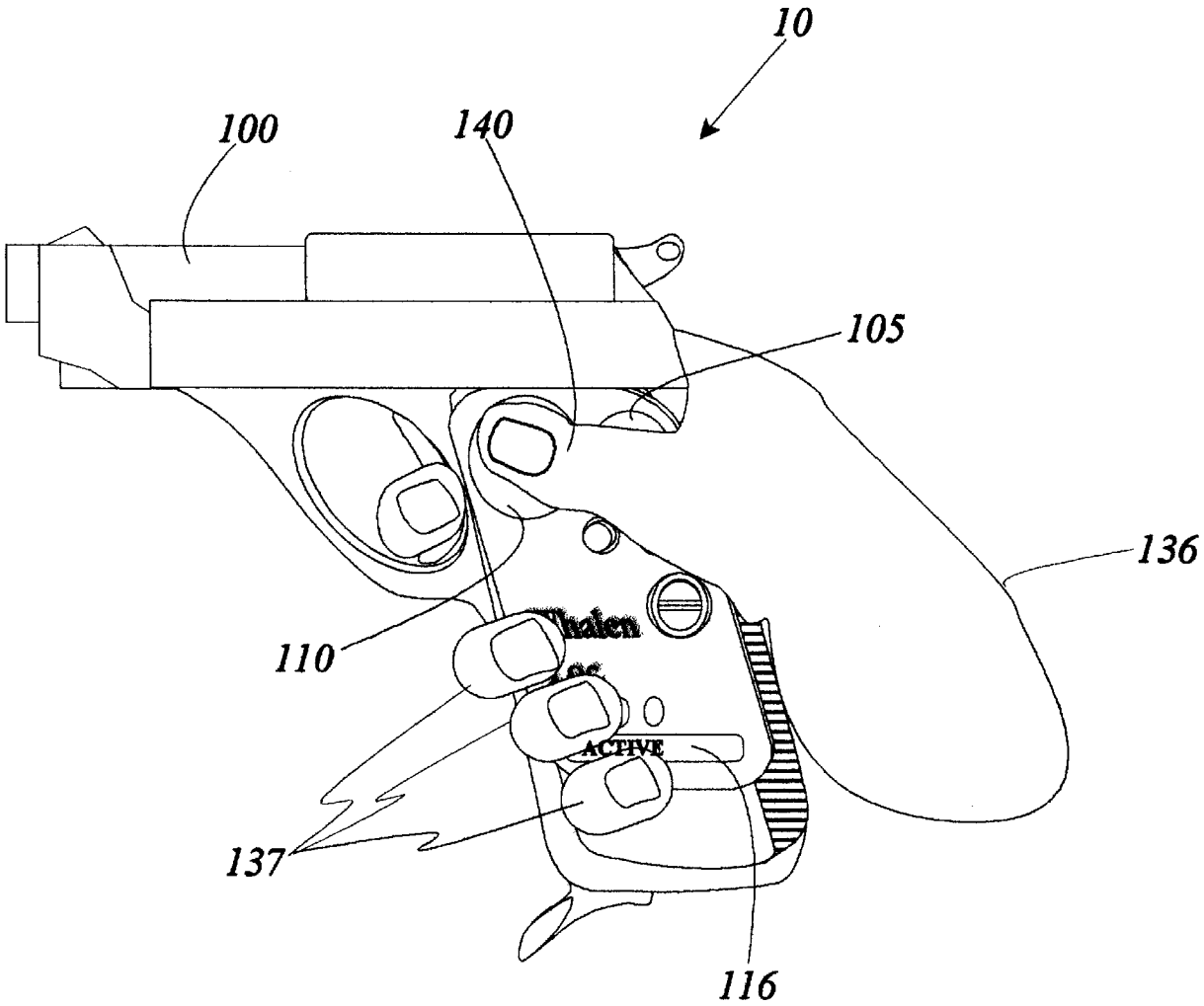
FIG. 5 is a side view of a gun with the safety system of the present invention mounted on the gun handle showing the user's finger over the protective membrane and the sensing integrated circuit.
Figure 6:
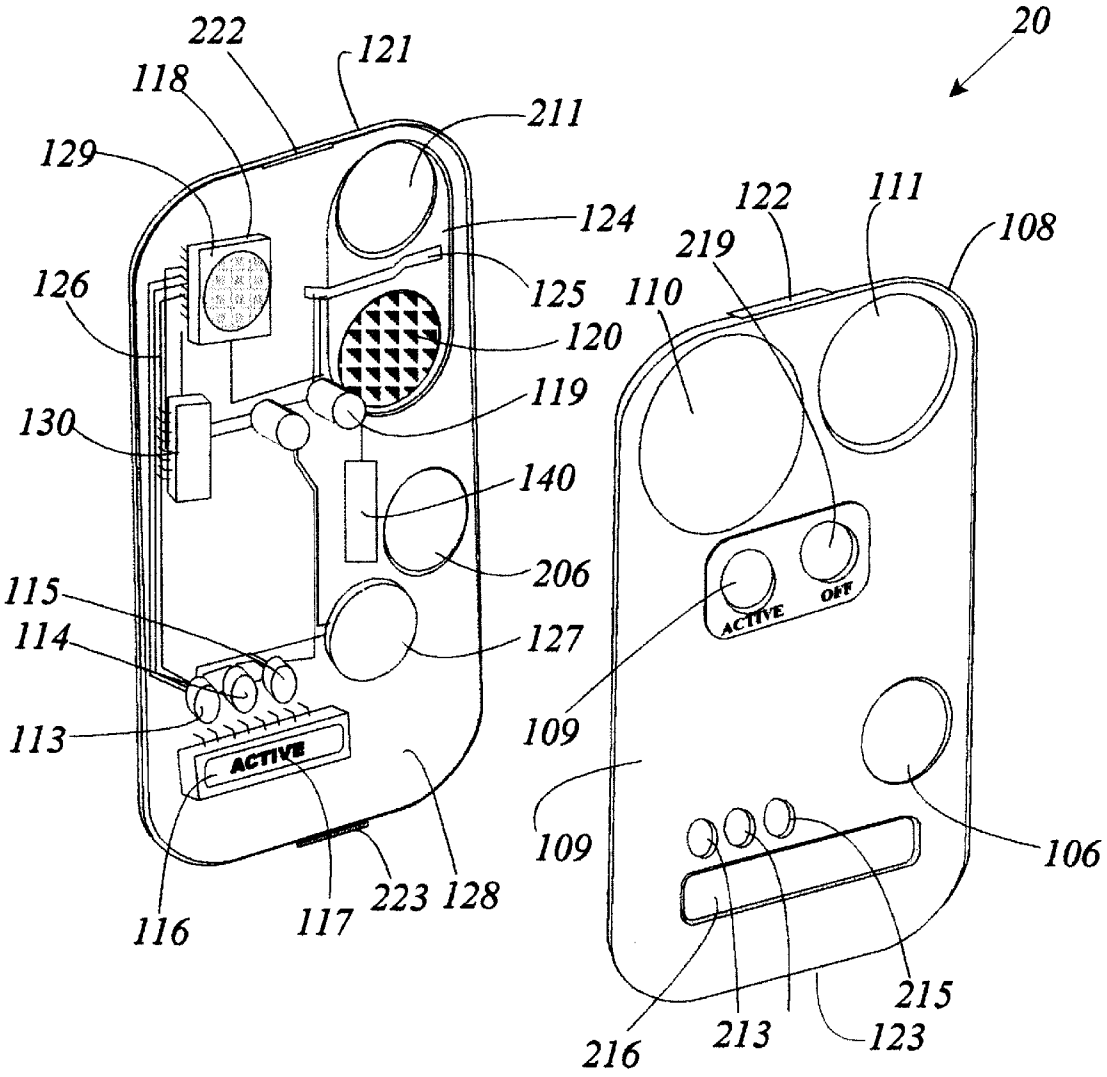
FIG. 6 is a perspective view of the cover removed from the base.
Figure 7:
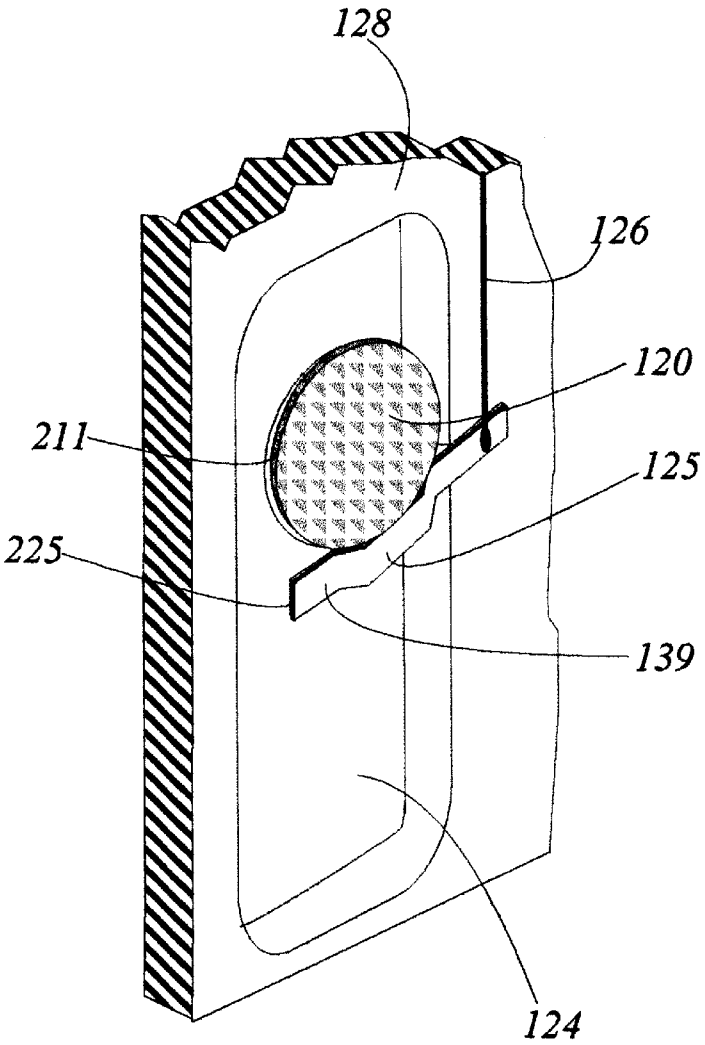
FIG. 7 is a perspective view of the base, in partial section, showing the blocking disk seated above the horizontally disposed bimetallic strip in the cavity.
Figure 8:
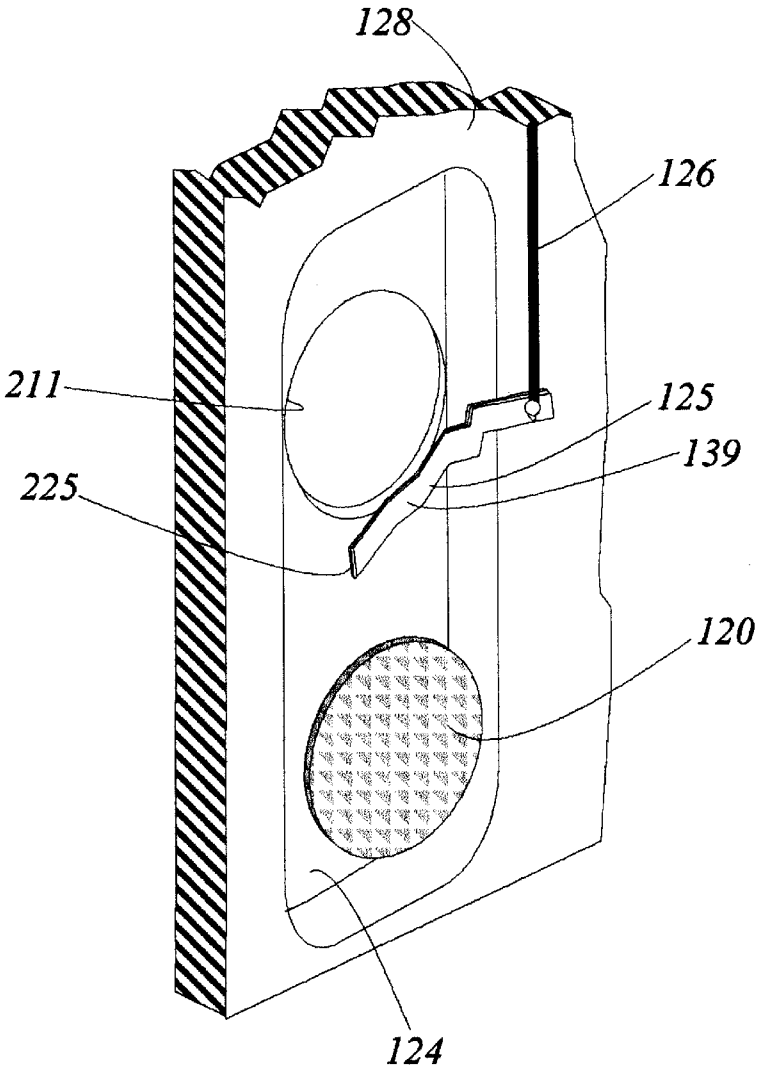
FIG. 8 is a perspective view of the base, in partial section, showing the blocking disk dropped below the bimetallic strip in the cavity.
Figure 9:
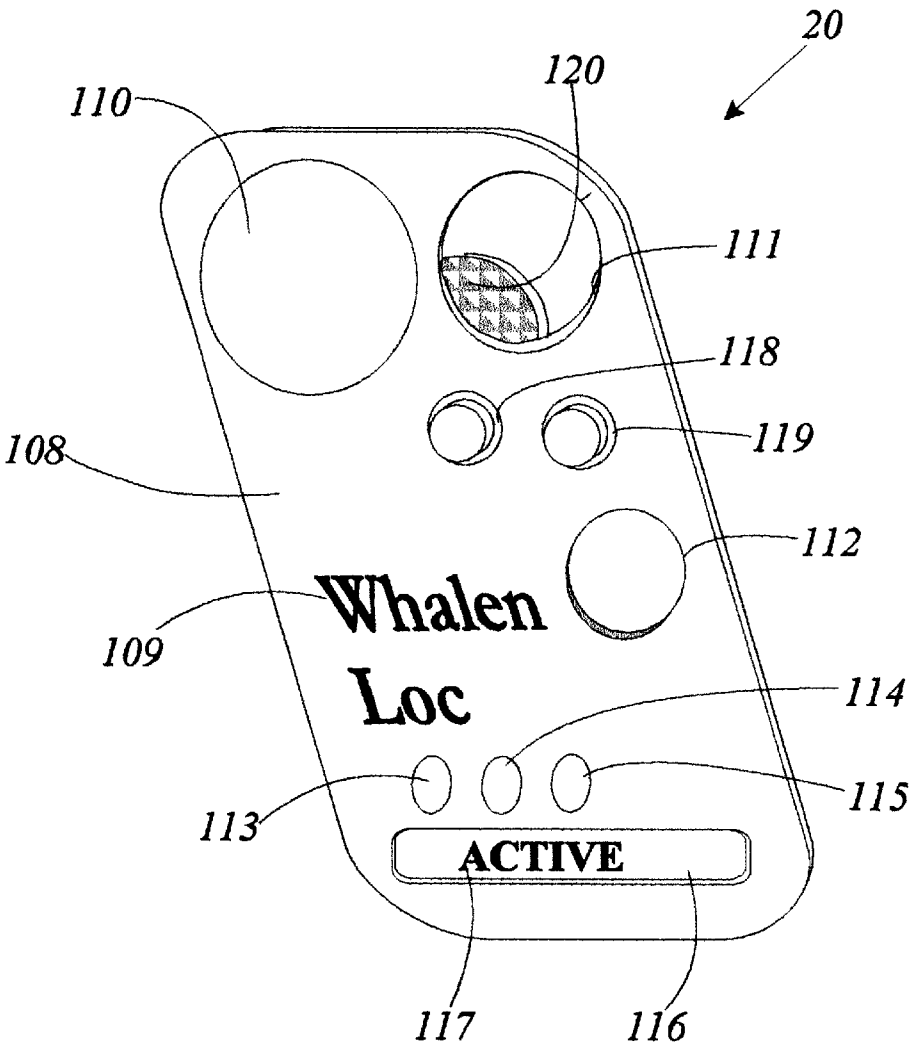
FIG. 9 is a perspective view of the cover.

Referring now to FIGS. 5, 7 and 8, in use the users finger is placed over the protective membrane 110 and pressure is exerted on the sensing circuit 129, causing the circuit to activate from its dormant state and sensing integrated circuit 129 to scan the finger thereon and receive a voice pattern from the user. The voice and finger print patterns are then transmitted to the authentication circuit 130 and compared with stored voice and finger print patterns. If the voice and/or finger print patterns are not authenticated, the safety latch 105 will remain in the locked position and an audible alarm will sound. If the voice and/or finger print patterns are authenticated, a signal is sent by the authentication circuit 130 causing capacitor 140 to release its stored energy to the strip 139, which, in turn, bends away from its normal horizontal orientation allowing blocking disk 120 to fall away from access ports 111, 211, as discussed above, thereby rendering the safety latch 105 accessible.

Figure 10:
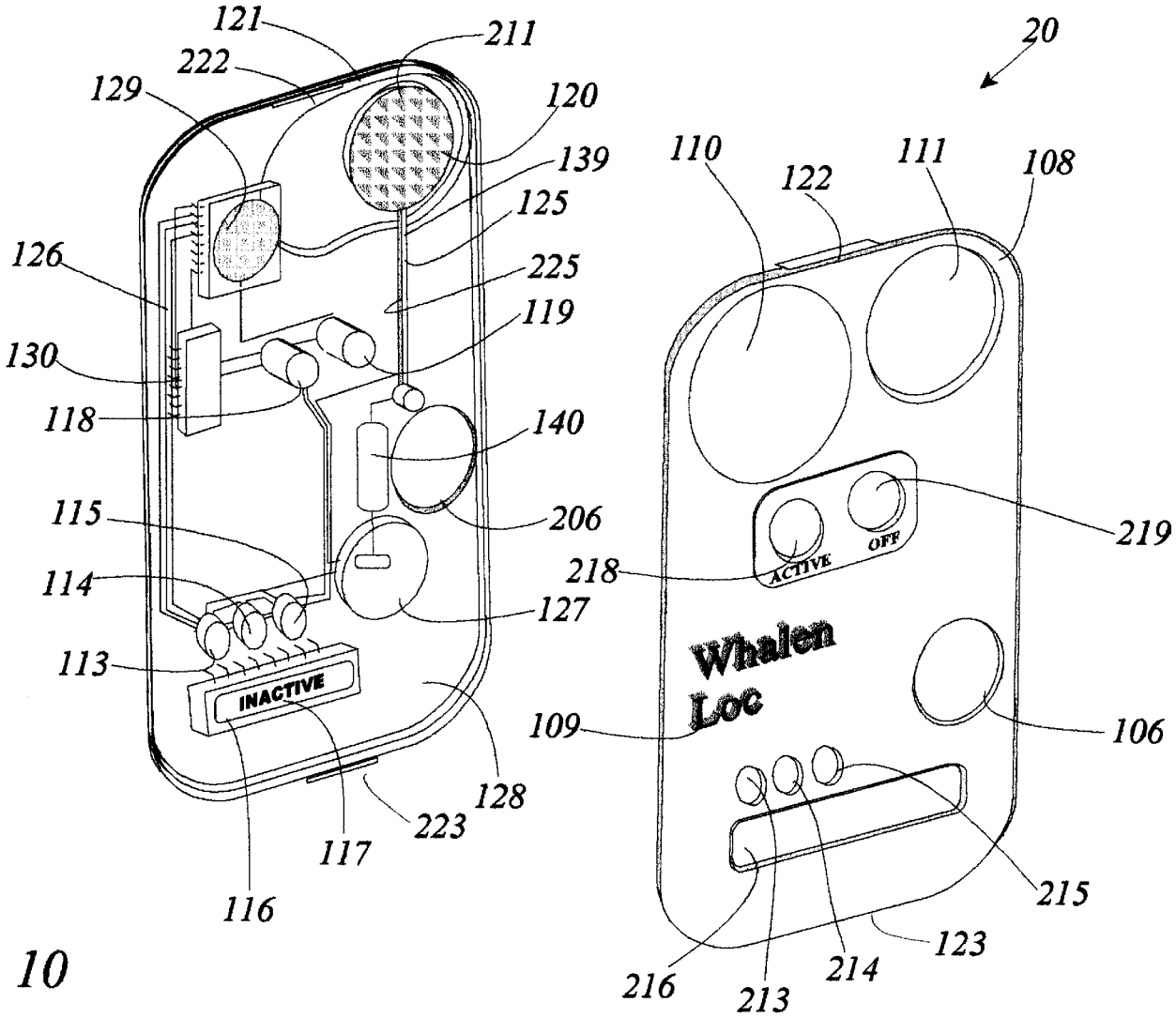
FIG. 10 is a perspective view of the base and cover showing the blocking disk attached to the upper end of the vertically disposed bimetallic strip over the access port.
Figure 11:
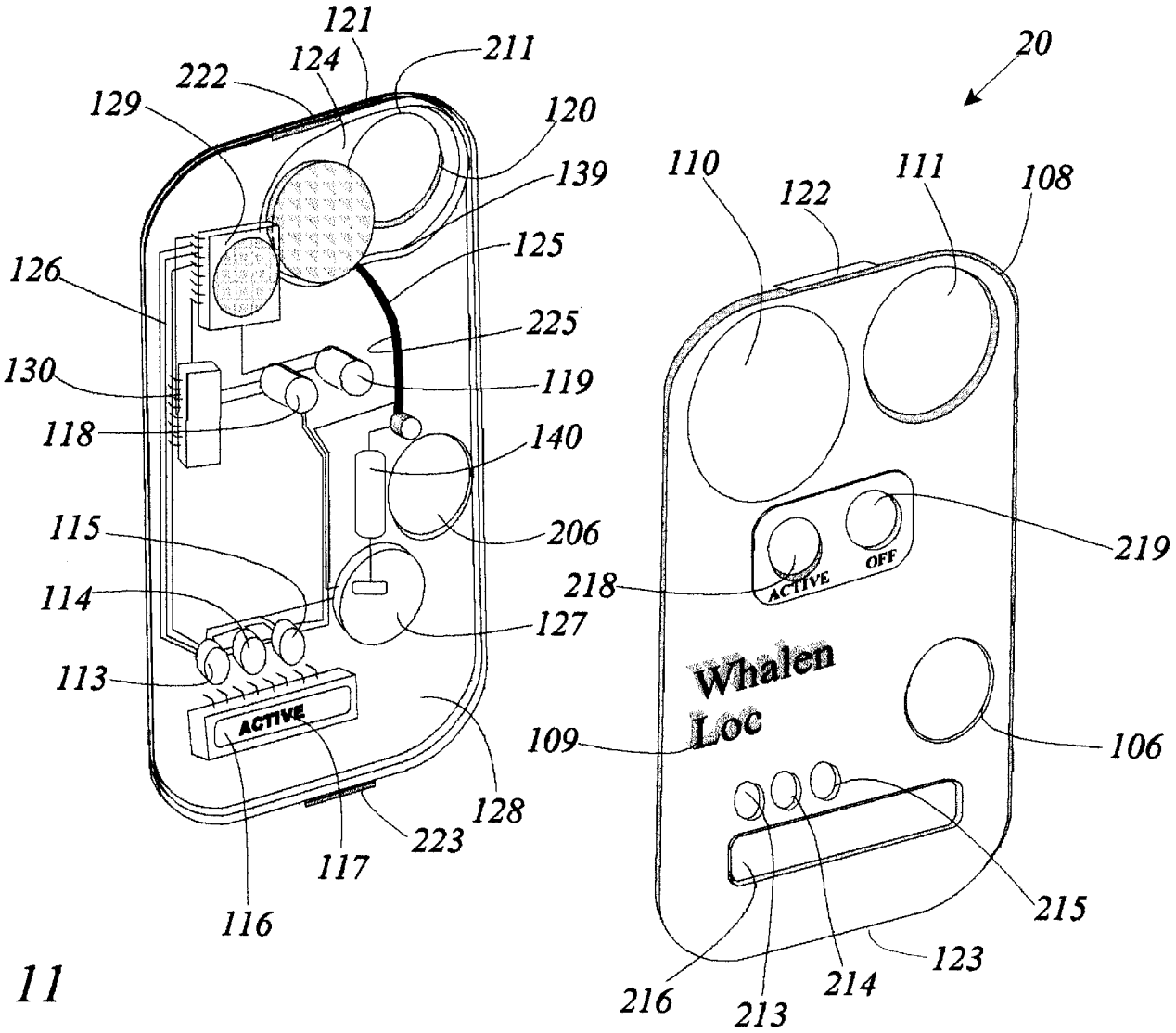
FIG. 11 is a perspective view of the base and cover showing the bimetallic strip and attached blocking disk bent away from the access port.

In a second preferred embodiment of the gun safety system 10 of the present invention, as shown in FIGS. 10 and 11, blocking disk 120 is attached to the upper end of vertically disposed bimetallic strip 125. Upon user authorization and release of the stored energy from the capacitor 140, the strip 125 and attached blocking disk 120 bends away from access ports 111, 211, again rendering the safety latch 105 accessible. Within a short time thereafter, the energy from capacitor 140 will have dissipated and the strip 125 will cool and return to its vertical orientation with the blocking disk 120 over the safety latch 105. Alternatively, the blocking disk 120 may be directly tied to the safety latch 105 so that the action of the blocking disk 120 in moving away from and back over the safety latch 105 may be used to rotate the safety latch 105 out of and back into the locked position. Thus, if the gun 100 were removed from the hands of an authorized user, the safety latch 105 will be redeployed, thereby preventing the gun 100 from being used by any unauthorized user.

Figure 13:
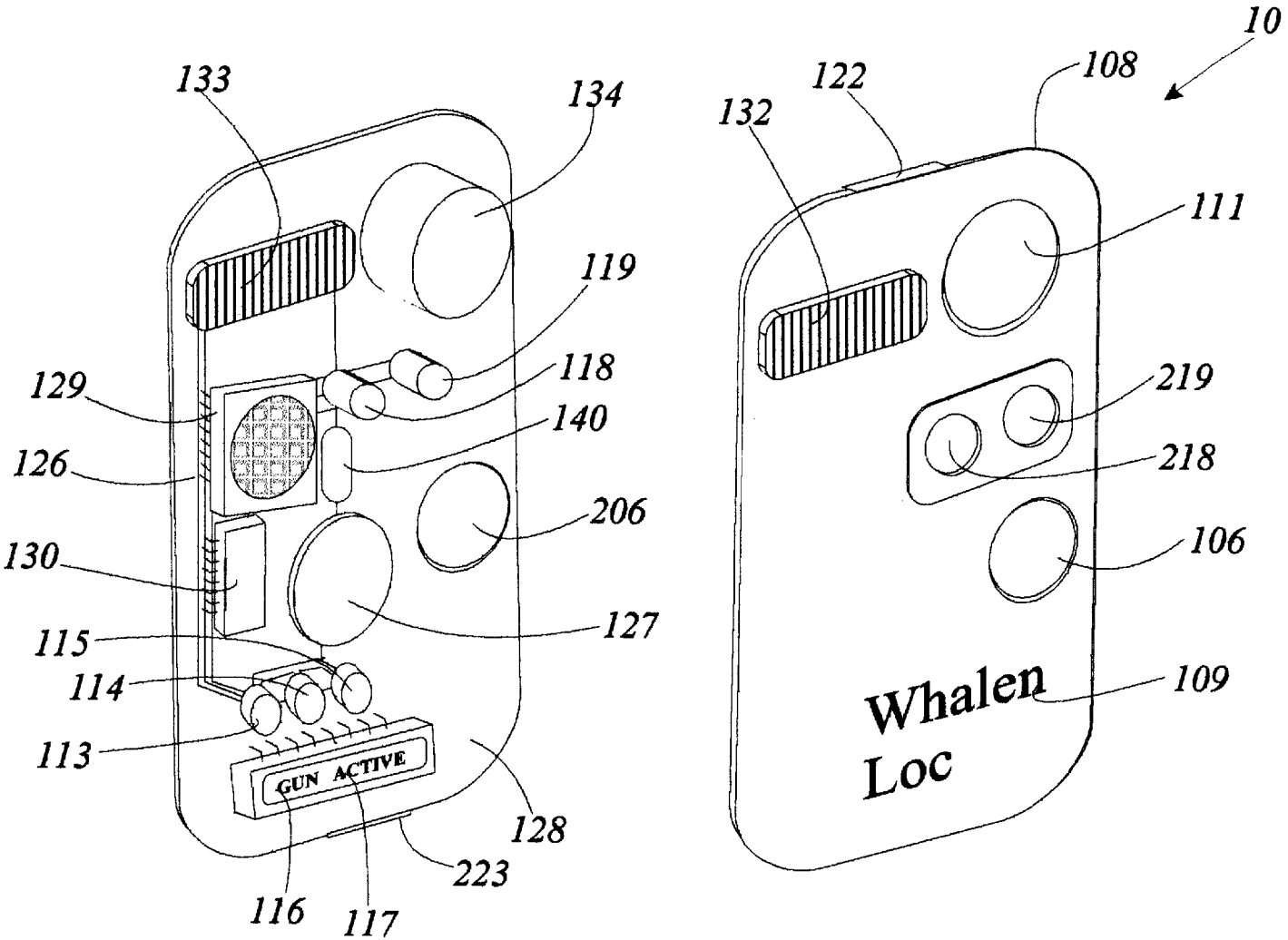
FIG. 13 is a perspective view of the base and cover showing the motor and fingerprint sensor.
Figure 14:
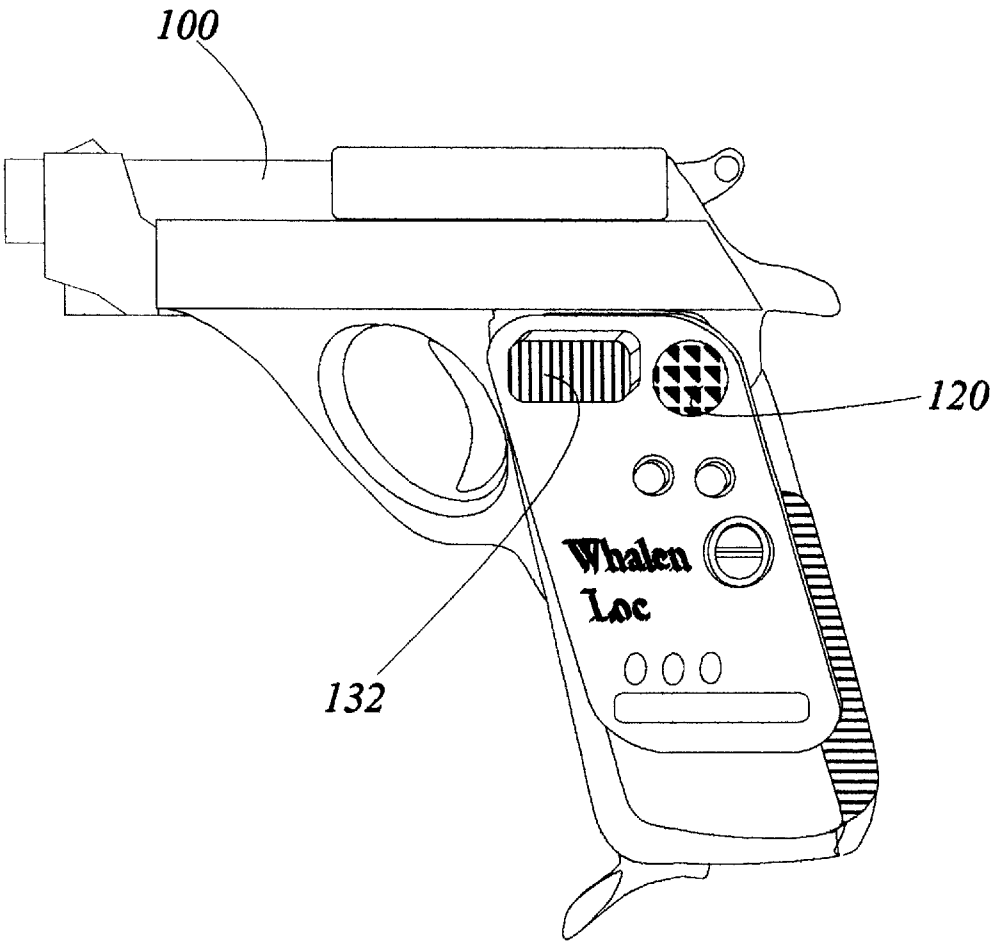
FIG. 14 is a side view of the embodiment of FIG. 13 mounted on the gun handle with the blocking disk covering the safety latch.
Figure 15:
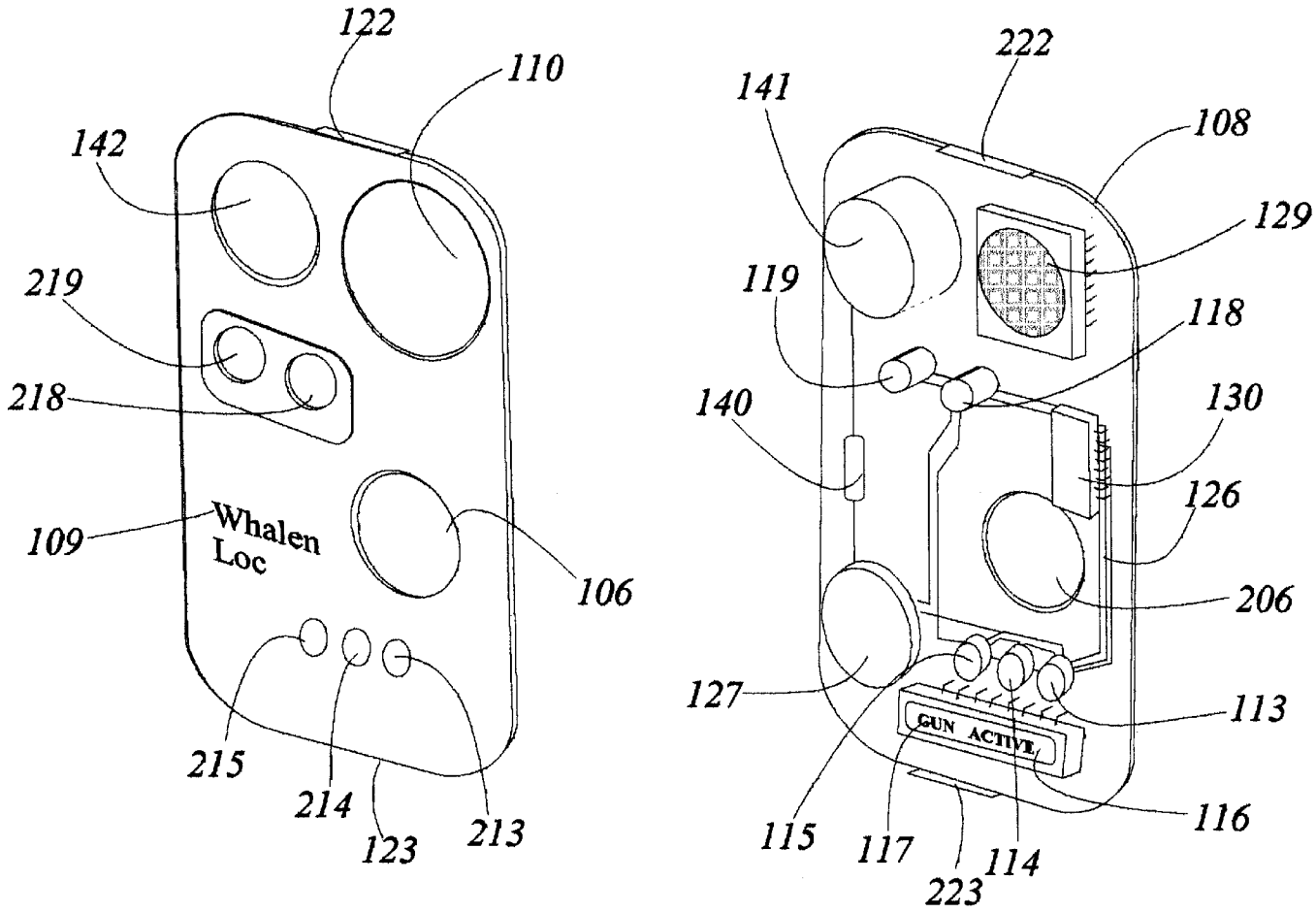
FIG. 15 is a perspective view of the base and cover showing the motor.

In another embodiment of the gun safety system 10 of the present invention, as shown in FIGS. 13–15, a sensor 132 comprised of a matrix of points corresponding to a unique pattern or area is used. In this embodiment, the user must wear a matching glove 135 on his or her hand 136. Placing the appropriate finger of the glove over the sensor 132 serves to close the circuit 126 and activate the motor 134. The motor 134, in turn, rotates and pushes or pulls the safety latch 105 out of and back into the locked position. Voice sensing may still be used with this embodiment to provide further user authentication. In this manner, the user must have both the correctly stored voice pattern and the glove with the proper electrically conductive markings in order to fire the gun 100. The glove 135 may be made from any suitable material infused with an electrically conductive wafer at the desired finger area.

Figure 16:
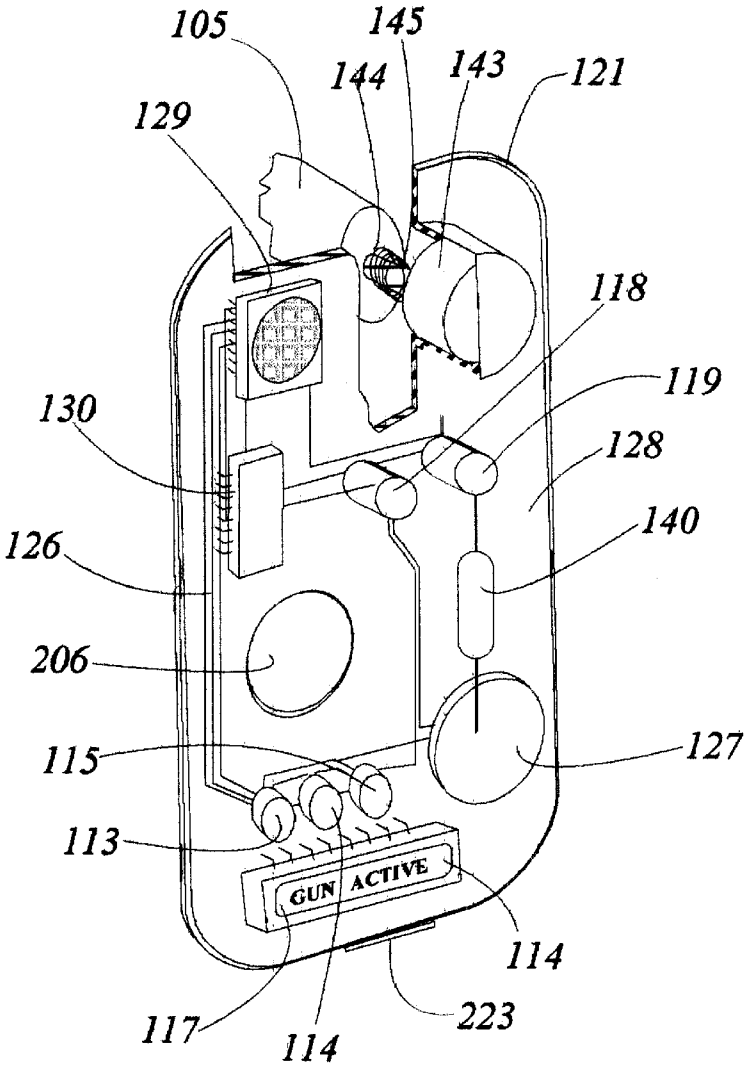
FIG. 16 is a perspective view of the base, in partial section, showing the motor and attached spring.

Referring now to FIGS. 15 and 16, yet another embodiment of the gun safety system 10 of the present invention is shown. In this embodiment, an electric motor 143 is used in place of the bimetallic strip to move the safety latch between the active and inactive positions. The safety latch 105 includes a helical thread (not shown), or other suitable attachment means, to mate with the motor shaft 144. In the absence of proper authentication, a coil spring 145 on the motor shaft 144 maintains the safety latch 105 in the inactive position. Upon proper authentication, the motor 143 is activated and rotated against the coil spring 145 to move the safety latch 105 into the active position. When the authorized finger is removed, the motor 143 is deactivated and the energy in the coil spring 145 causes the motor shaft 144 to rotate back to its initial position, thereby moving the safety latch 105 back to its inactive position.

Figure 17:
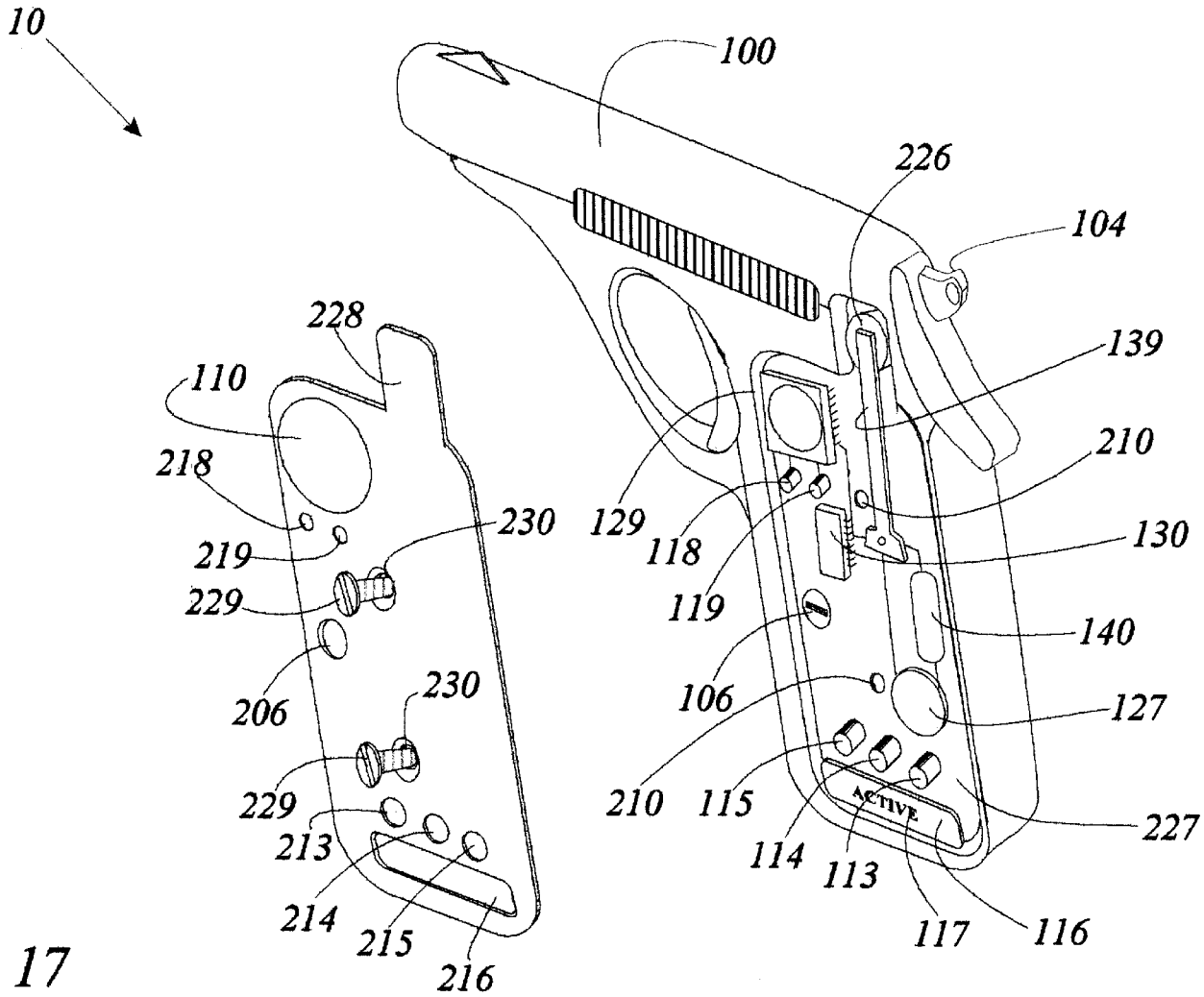
FIG. 17 is a perspective view of the present invention showing the safety system, with the cover removed, integrally installed within the gun handle and the safety pin locked within the hammer.

In yet a further embodiment of the present invention, as shown in FIGS. 17 and 18, the gun safety system may be mounted within the gun handle 107. In this embodiment, the components which were mounted on the base 121 in the embodiments discussed above, are installed within a recessed cavity 227 in the handle 107. The cover 108 includes an upper flanged portion 228 and is structured for attachment to the handle 107 via aligned mounting holes 230, 210 and screws 229. A safety pin 226 is mounted to the top portion of the bimetallic strip 139 and is structured and disposed to slidingly engage a hole 231 in the hammer 104. In the absence of user authorization, bimetalic strip 139 engages the hole 231 in the hammer 104, thereby retaining the hammer 104 in the gun 100 and rendering the gum inoperable. Upon user authorization and release of the stored energy from the capacitor 140, the strip 139 and attached safety pin 226 bend away from the hole 231, thereby enabling the hammer 104 to be cocked and the gun to be fired by depressing the trigger. Almost immediately thereafter, the energy from capacitor 140 will have dissipated and the strip 139 will cool and return to its vertical orientation with the safety pin 226 secured within the hole 231.

The gun safety system 10 may also include means for remotely deactivating the gun 100. Such means may include a verbal code or other audible or inaudible signal stored in the authentication integrated circuit 130. Upon receipt of such code or signal, the safety latch 105 will automatically engage in the inactive position, thereby preventing the gun 100 from being fired. This feature will enable law enforcement officers to safely disarm people threatening to use guns against such officers or other parties.

Figure 12:
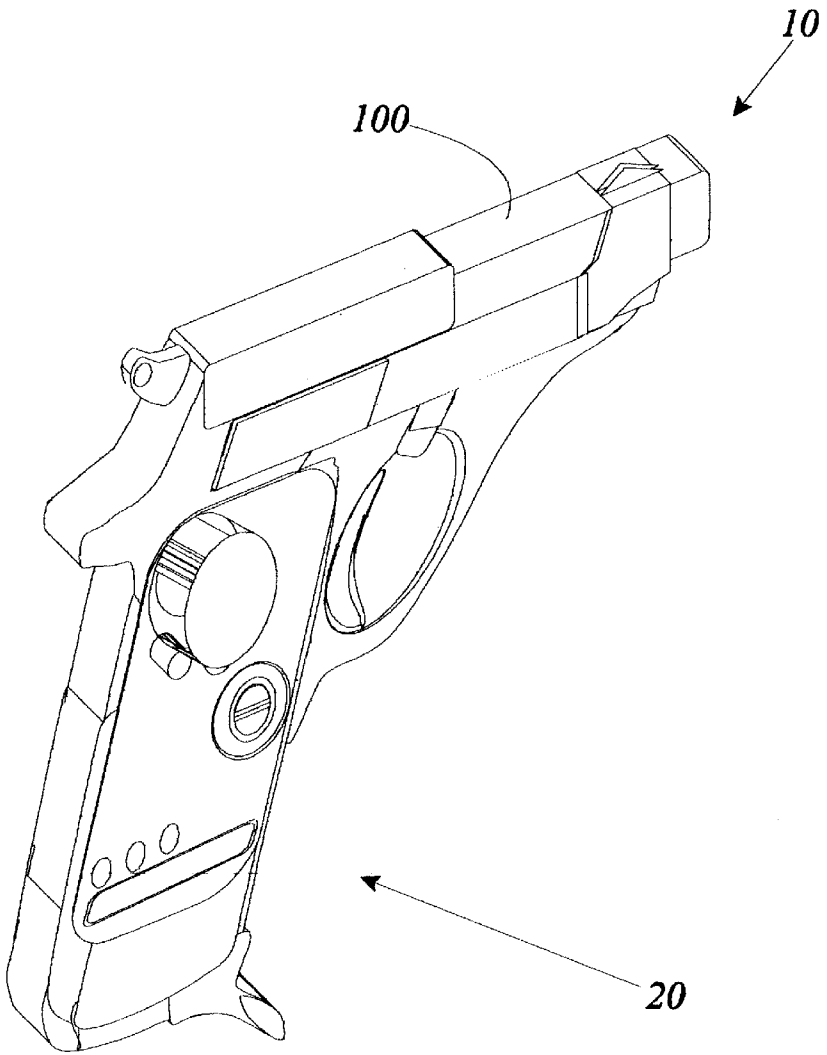
FIG. 12 is a perspective view of the embodiment of FIG. 13 showing the main housing mounted on the opposite side of the handle for use with a user's left hand.

Although the above referenced figures illustrate the various embodiments for use with a user's right hand, it should be appreciated that the present invention may also be adapted for use with a user's left hand. FIG. 12 illustrates such an embodiment.

While the invention has been described, disclosed, illustrated and shown in various terms of certain embodiments or modifications, which it has presumed in practice, the scope of the invention is not intended to be, nor should it be deemed to be, limited thereby and such other modifications or embodiments as may be suggested by the teachings herein are particularly reserved, especially as they fall within the breadth and scope of the claims here appended.

What is claimed is:

1. A gun safety system for use with a gun having a handle, a barrel, a firing mechanism and a safety latch comprising:

a main housing mounted to a first side of the gun handle over a safety latch, said main housing including means for blocking access to said safety latch structured for movement from a first blocked position wherein said safety latch is inaccessible to a second unblocked position wherein said safety latch is accessible, said main housing further including means for verifying an authorized user operably connected to said means for blocking access to said safety latch, whereby said means for blocking access to said safety latch moves from said first blocked position to said second unblocked position upon verification of an authorized user and returns to said first blocked position upon absence of verification of an authorized user;

wherein said means for blocking access to said safety latch comprises a stored energy circuit electronically interconnected to said means for verifying an authorized user, a generally horizontally disposed strip having a first end constructed of a first metal and a second end constructed of a second dissimilar metal electrically interconnected to said stored energy circuit, and a substantially flat blocking member seated above said strip, said strip and said blocking member being structured and disposed so that in the absence of verification of an authorized user by said means for verifying an authorized user, said blocking member covers said safety latch and upon verification of an authorized user by said means for verifying an authorized user, said stored energy circuit releases its stored energy causing said first and second ends of said strip to expand at different rates, said strip to bend away from its horizontal position and said blocking member to fall away from said safety latch, thereby making said safety latch accessible to said authorized user.

2. A gun safety system as recited in claim 1 wherein said means for verifying an authorized user comprises a voice recording and comparison circuit structured to record a voice sample from a source and compare said voice sample with at least one stored authorized voice sample to determine whether said source is authorized to fire said gun.

3. A gun safety system as recited in claim 2 wherein said voice recording and comparison circuit comprises a microphone structured to record said voice sample and a comparison circuit structured to compare said voice sample with said at least one stored authorized voice sample.

4. A gun safety system as recited in claim 1 wherein said means for verifying an authorized user comprises a finger print scanning and comparison circuit structured to scan a finger print sample from a source and compare said finger print sample with at least one stored authorized finger print sample to determine whether said source is authorized to fire said gun.

5. A gun safety system as recited in claim 4 wherein said finger print scanning and comparison means comprises a sensor structured to scan said finger print sample and a comparison circuit structured to compare said finger print sample with said at least one stored authorized finger print sample.

6. A gun safety system for use with a gun having a handle, a barrel, a firing mechanism and a safety latch comprising:

a main housing mounted to a first side of the gun handle over a safety latch, said main housing including means for blocking access to said safety latch structured for movement from a first blocked position wherein said safety latch is inaccessible to a second unblocked position wherein said safety latch is accessible, said main housing further including means for verifying an authorized user operably connected to said means for blocking access to said safety latch, whereby said means for blocking access to said safety latch moves from said first blocked position to said second unblocked position upon verification of an authorized user and returns to said first blocked position upon absence of verification of an authorized user;

wherein said means for blocking access to said safety latch comprises a stored energy circuit electronically interconnected to said means for verifying an authorized user, a generally vertically disposed strip having an upper end constructed of a first metal and a lower end constructed of a second dissimilar metal electronically interconnected to said stored energy circuit, and a substantially flat blocking member attached to said upper end of said strip, said strip and said blocking member being structured and disposed so that in the absence of verification of an authorized user by said means for verifying an authorized user, said blocking member covers said safety latch and upon verification of an authorized user by said means for verifying an authorized user, said stored energy circuit releases its stored energy causing said upper and lower ends of said strip to expand at different rates and said strip to bend away from its vertical position, thereby moving said blocking member away from said safety latch and making said safety latch accessible to said authorized user.

7. A gun safety system as recited in claim 1 further comprising an audible alarm signal operably connected to said means for verifying an authorized user and structured to produce an audible alarm upon indication of an unauthorized user by said means for verifying an authorized user.

8. A gun safety system as recited in claim 1 further comprising means for remotely engaging said safety latch.

9. A gun safety system as recited in claim 8 wherein said means for remotely engaging said safety latch comprises a signal stored in said voice recording and comparison means, whereby upon receipt of such signal, said means for blocking access to said safety latch moves to said first blocked position.

10. A gun safety system for use with a gun having a handle, a barrel, a firing mechanism and a safety latch comprising:

a main housing mounted to a first side of the gun handle over a safety latch, said main housing including means for blocking access to said safety latch structured for movement from a first blocked position wherein said safety latch is inaccessible to a second unblocked position wherein said safety latch is accessible, said main housing further including means for verifying an authorized user operably connected to said means for blocking access to said safety latch, whereby said means for blocking access to said safety latch moves from said first blocked position to said second unblocked position upon verification of an authorized user and returns to said first blocked position upon absence of verification of an authorized user; and said means for verifying an authorized user including a voice recording and comparison circuit structured to record a voice sample from a source and compare said voice sample with at least one stored authorized voice sample to determine whether said source is authorized to fire said gun;

wherein said means for blocking access to said safety latch comprises a stored energy circuit electrically interconnected to said means for verifying an authorized user, a generally horizontally disposed strip having a first end constructed of a first metal and a second end constructed of a second dissimilar metal electrically interconnected to said stored energy circuit, and a substantially flat blocking member seated above said strip, said strip and said blocking member being structured and disposed so that in the absence of verification of an authorized user by said means for verifying an authorized user, said blocking member covers said safety latch and upon verification of an authorized user by said means for verifying an authorized user, said stored energy circuit releases its stored energy causing said first and second ends of said strip to expand at different rates, said strip to bend away from its horizontal position and said blocking member to fall away from said safety latch, thereby making said safety latch accessible to said authorized user.

11. A gun safety system as recited in claim 10 wherein said voice recording and comparison circuit comprises a microphone structured to record said voice sample and a comparison circuit structured to compare said voice sample with said at least one stored authorized voice sample.

12. A gun safety system as recited in claim 10 wherein said means for verifying an authorized user further includes a finger print scanning and comparison circuit structured to scan a finger print sample from said source and compare said finger print sample with at least one stored authorized finger print sample to determine whether said source is authorized to fire said gun.

13. A gun safety system as recited in claim 12 wherein said finger print scanning and comparison means comprises a sensor structured to scan said finger print sample and a comparison circuit structured to compare said finger print sample with said at least one stored authorized finger print sample.

14. A gun safety system for use with a gun having a handle, a barrel, a firing mechanism and a safety latch comprising:

a main housing mounted to a first side of the gun handle over a safety latch, said main housing including means for blocking access to said safety latch structured for movement from a first blocked position wherein said safety latch is inaccessible to a second unblocked position wherein said safety latch is accessible, said main housing further including means for verifying an authorized user operably connected to said means for blocking access to said safety latch, whereby said means for blocking access to said safety latch moves from said first blocked position to said second unblocked Position upon verification of an authorized user and returns to said first blocked position upon absence of verification of an authorized user; and said means for verifying an authorized user including a voice recording and comparison circuit structured to record a voice sample from a source and compare said voice sample with at least one stored authorized voice sample to determine whether said source is authorized to fire said gun;

wherein said means for blocking access to said safety latch comprises a stored energy circuit electrically interconnected to said means for verifying an authorized user, a generally vertically disposed strip having an upper end constructed of a first metal and a lower end constructed of a second dissimilar metal electrically interconnected to said stored energy circuit, and a substantially flat blocking member attached to said upper end of said strip, said strip and said blocking member being structured and disposed so that in the absence of a verification of an authorized user by said means for verifying an authorized user, said blocking member covers said safety latch and upon verification of an authorized user by said means for verifying an authorized user, said stored energy circuit release its stored energy causing said upper and lower ends of said strip to expand at different rates and said strip to bend away from its vertical position, thereby moving said blocking member away from said safety latch and making said safety latch accessible to said authorized user.

15. A gun safety system as recited in claim 10 further comprising an audible alarm signal operably connected to said means for verifying an authorized user and structured to produce an audible alarm upon indication of an unauthorized user by said means for verifying an authorized user.

16. A gun safety system as recited in claim 10 further comprising means for remotely engaging said safety latch.

17. A gun safety system as recited in claim 16 wherein said means for remotely engaging said safety latch comprises a signal stored in said voice recording and comparison means, whereby upon receipt of such signal said means for blocking access to said safety latch moves to said first blocked position.

* * * * *